US011952238B2

(12) United States Patent
Shimosaka et al.

(10) Patent No.: US 11,952,238 B2
(45) Date of Patent: Apr. 9, 2024

(54) DOUBLE FEEDING DETECTION DEVICE, CONTROL METHOD, AND CONTROL PROGRAM

(71) Applicant: PFU LIMITED, Kahoku (JP)

(72) Inventors: Kiichiro Shimosaka, Kahoku (JP); Masaaki Sakai, Kahoku (JP)

(73) Assignee: PFU LIMITED, Kahoku (JP)

( * ) Notice: Subject to any disclaimer, the term of this patent is extended or adjusted under 35 U.S.C. 154(b) by 408 days.

(21) Appl. No.: 17/310,321

(22) PCT Filed: Mar. 20, 2019

(86) PCT No.: PCT/JP2019/011831
§ 371 (c)(1),
(2) Date: Jul. 27, 2021

(87) PCT Pub. No.: WO2020/188811
PCT Pub. Date: Sep. 24, 2020

(65) Prior Publication Data

US 2022/0073302 A1 Mar. 10, 2022

(51) Int. Cl.
*B65H 7/12* (2006.01)

(52) U.S. Cl.
CPC ..... *B65H 7/125* (2013.01); *B65H 2220/03* (2013.01); *B65H 2553/30* (2013.01)

(58) Field of Classification Search
CPC . B65H 7/125; B65H 2220/03; B65H 2553/30
See application file for complete search history.

(56) References Cited

U.S. PATENT DOCUMENTS

2012/0113488 A1 5/2012 Machida et al.
2013/0069299 A1* 3/2013 Matsuoka ..... B65H 5/06 271/225

FOREIGN PATENT DOCUMENTS

JP 2009-137716 A 6/2009
JP 2012-111565 A 6/2012
JP 2013-10600 * 1/2013
(Continued)

OTHER PUBLICATIONS

Machine translation of JP2015-78039 (Year: 2015).*
(Continued)

*Primary Examiner* — Thomas A Morrison
(74) *Attorney, Agent, or Firm* — LEWIS ROCA ROTHGERBER CHRISTIE LLP

(57) ABSTRACT

Provided are a multi-feed detection apparatus, a control method, and a control program to suitably determine whether or not the multi-feed detection apparatus returns a fed medium to a direction of a medium tray when multi-feed has occurred. A multi-feed detection apparatus includes an ultrasonic sensor to generate an ultrasonic signal, a multi-feed determination module to determine that feeding of the medium is normal when a signal value of the ultrasonic signal is equal to or more than a first threshold value, and determine that a multi-feed of the medium has occurred when the signal value of the ultrasonic signal is less than the first threshold value, and a control module to control the feed module to return the fed medium to a direction of the medium tray when the signal value of the ultrasonic signal is less than a second threshold value smaller than the first threshold value.

15 Claims, 11 Drawing Sheets

(56) References Cited

FOREIGN PATENT DOCUMENTS

| | | | | |
|---|---|---|---|---|
| JP | 2013-63843 | A | | 4/2013 |
| JP | 2013-82539 | A | | 5/2013 |
| JP | 2015-78039 | | * | 4/2015 |
| JP | 2016-204130 | A | | 12/2016 |

OTHER PUBLICATIONS

Machine translation of JP2013-10600 (Year: 2013).*
Japanese Office Action for JP Application No. 2021-506107 dated Jun. 15, 2022, 5 pages.
International Search Report dated Jun. 4, 2019 for corresponding PCT Application No. PCT/JP2019/011831 (3 pages) with English Translation (2 pages).
Written Opinion dated Jun. 4, 2019 for corresponding PCT Application No. PCT/JP2019/011831 (5 pages) with English Translation (9 pages).
International Preliminary Report on Patentability dated Sep. 16, 2021 for corresponding PCT Application No. PCT/JP2019/011831 (6 pages) with English Translation (10 pages).
Japanese Office Action dated Feb. 1, 2022 regarding Japanese Patent Application No. 2021-506107 corresponding to U.S. Appl. No. 17/310,321 (3 pages) with English Translation (5 pages).

* cited by examiner

DOUBLE FEEDING DETECTION DEVICE, CONTROL METHOD, AND CONTROL PROGRAM

CROSS-REFERENCE TO RELATED APPLICATION(S)

This application is a U.S. National Phase Patent Application of International Application Number PCT/JP2019/011831, filed on Mar. 20, 2019, the entire content of which is incorporated herein by reference.

FIELD

The present disclosure relates to a multi-feed detection apparatus, a control method and a control program, and more particularly, to a multi-feed detection apparatus, a control method and a control program to detect multi-feed using ultrasonic waves.

BACKGROUND

An apparatus such as a scanner to feed a medium such as a document and reads an image of the fed medium has a function of detecting whether or not a multi-feed in which a plurality of media are fed in an overlapping manner has occurred. In general, a multi-feed detection apparatus such as a scanner includes an ultrasonic transmitter to transmit an ultrasonic wave and an ultrasonic receiver to generate a signal corresponding to a received ultrasonic wave, and detects multi-feed based on the signal output by the ultrasonic receiver when the medium is fed. Such a multi-feed detection apparatus is desired to automatically return the media fed in an overlapping manner to a medium tray when the multi-feed has occurred, in order to improve a convenience of a user.

However, when the fed medium is thin paper, etc., damage or jam of the medium, etc., may occur by attempting to automatically return the medium to the medium tray.

A document conveying apparatus to notify prompting a selection of whether to reversely feed a document or to stop the conveyance of the document when a multi-feed of the document is detected, is disclosed (PTL 1). The document conveying apparatus reversely feeds the document to discharge it to a document feed tray when an instruction to reversely feed a document is received, and the document conveying apparatus stops the conveyance of the document when an instruction to stop the conveyance is received.

CITATION LIST

Patent Literature

[PTL 1] Japanese Unexamined Patent Application Publication Kokai) No. 2009-137716

SUMMARY

The multi-feed detection apparatus is desired to suitably determine whether or not it returns the fed medium to a direction of the medium tray when the multi-feed has occurred.

An object of the multi-feed detection apparatus, the control method and the control program is to suitably determine whether or not the multi-feed detection apparatus returns the fed medium to the direction of the medium tray when the multi-feed has occurred.

According to some embodiments, a multi-feed detection apparatus includes a medium tray, a feed module to feed a medium placed on the medium tray, an ultrasonic sensor including an ultrasonic transmitter to transmit an ultrasonic wave and an ultrasonic receiver located to face the ultrasonic transmitter and to generate an ultrasonic signal corresponding to a received ultrasonic wave, a multi-feed determination module to determine that feeding of the medium is normal when a signal value of the ultrasonic signal is equal to or more than a first threshold value, and determine that a multi-feed of the medium has occurred when the signal value of the ultrasonic signal is less than the first threshold value, and a control module to control the feed module to return the fed medium to a direction of the medium tray when the signal value of the ultrasonic signal is less than a second threshold value smaller than the first threshold value.

According to some embodiments, a control method of a multi-feed detection apparatus including a medium tray, a feed module to feed a medium placed on the medium tray, an ultrasonic sensor including an ultrasonic transmitter to transmit an ultrasonic wave and an ultrasonic receiver located to face the ultrasonic transmitter and to generate an ultrasonic signal corresponding to a received ultrasonic wave, includes determining that feeding of the medium is normal when a signal value of the ultrasonic signal is equal to or more than a first threshold value, determining that a multi-feed of the medium has occurred when the signal value of the ultrasonic signal is less than the first threshold value, and controlling the feed module to return the fed medium to a direction of the medium tray when the signal value of the ultrasonic signal is less than a second threshold value smaller than the first threshold value.

According to some embodiments, a control program of a multi-feed detection apparatus including a medium tray, a feed module to feed a medium placed on the medium tray, an ultrasonic sensor including an ultrasonic transmitter to transmit an ultrasonic wave and an ultrasonic receiver located to face the ultrasonic transmitter and to generate an ultrasonic signal corresponding to a received ultrasonic wave, causes the multi-feed detection apparatus to execute determining that feeding of the medium is normal when a signal value of the ultrasonic signal is equal to or more than a first threshold value, determining that a multi-feed of the medium has occurred when the signal value of the ultrasonic signal is less than the first threshold value, and controlling the feed module to return the fed medium to a direction of the medium tray when the signal value of the ultrasonic signal is less than a second threshold value smaller than the first threshold value.

According to the present embodiment, the multi-feed detection apparatus, the control method and the control program can suitably determine whether or not the multi-feed detection apparatus returns the fed medium to the direction of the medium tray when the multi-feed has occurred.

The object and advantages of the invention will be realized and attained by means of the elements and combinations, in particular, described in the claims. It is to be understood that both the foregoing general description and the following detailed description are exemplary and explanatory, and are not restrictive of the invention, as claimed.

DESCRIPTION OF EMBODIMENTS

Hereinafter, a multi-feed detection apparatus, a control method and a control program according to an embodiment, will be described with reference to the drawings. However, it should be noted that the technical scope of the invention is not limited to these embodiments, and extends to the inventions described in the claims and their equivalents.

Figure 1:
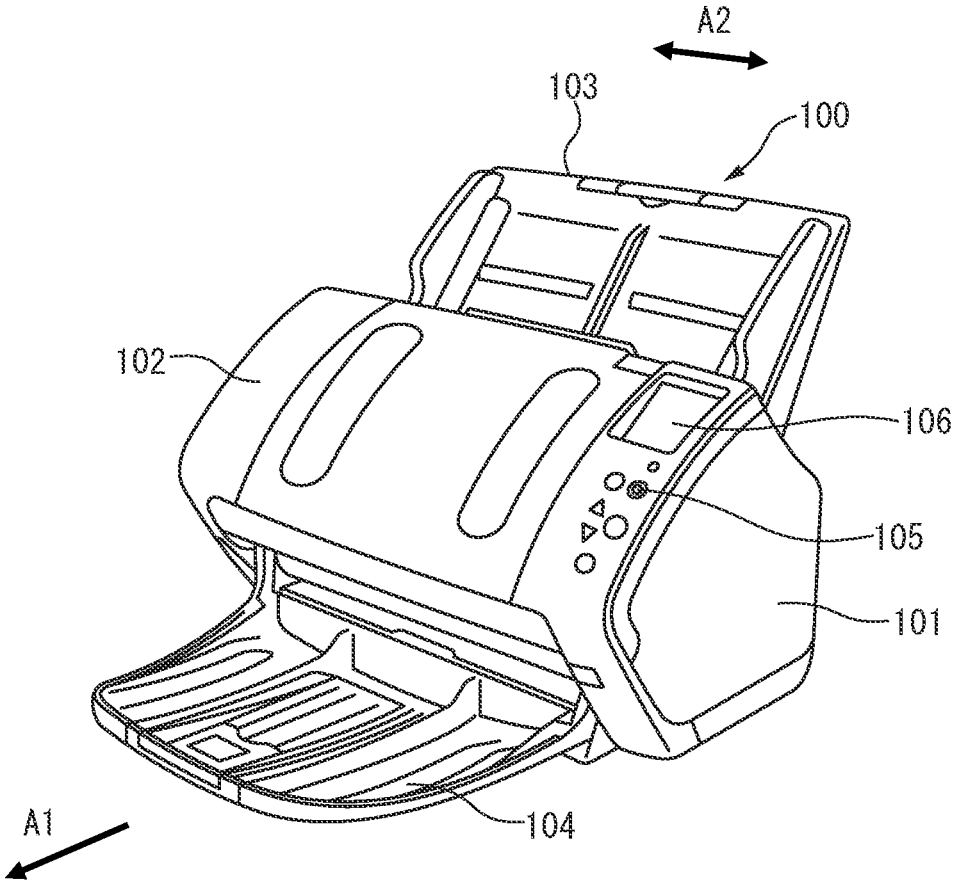
FIG. 1 is a perspective view illustrating a multi-feed detection apparatus 100 according to an embodiment.

FIG. 1 is a perspective view showing a multi-feed detection apparatus 100 configured as an image scanner. The multi-feed detection apparatus 100 conveys and images a medium being a document. A medium is paper, thick paper, a card, a brochure, a passport, etc. For example, a card is a plastic resin card. Particularly, a card is an identification (ID) card defined by International Organization for Standardization (ISO)/International Electrotechnical Commission (IEC) 7810. A card may be another type of card. The multi-feed detection apparatus 100 may be a facsimile, a copying machine, a printer multifunction machine (MFP, Multifunction Peripheral), etc. A conveyed medium may not be a document but may be an object being printed on, etc., and the multi-feed detector 100 may be a printer, etc.

The multi-feed detection apparatus 100 includes a lower housing 101, an upper housing 102, a medium tray 103, an ejection tray 104, an operation device 105 and a display device 106, etc.

The upper housing 102 is located in a position covering a top surface of the multi-feed detection apparatus 100, and is engaged with the lower housing 101. The medium tray 103 is engaged with the lower housing 101 in such a way as to be able to place a medium to be fed. The ejection tray 104 is engaged with the lower housing 101 in such a way as to be able to hold an ejected medium.

The operation device 105 includes an input device such as a button, and an interface circuit acquiring a signal from the input device, receives an input operation by a user, and outputs an operation signal based on the input operation by the user. The display device 106 includes a display including a liquid crystal or organic electro-luminescence EEL), and an interface circuit for outputting image data to the display, and displays the image data on the display.

Figure 2:
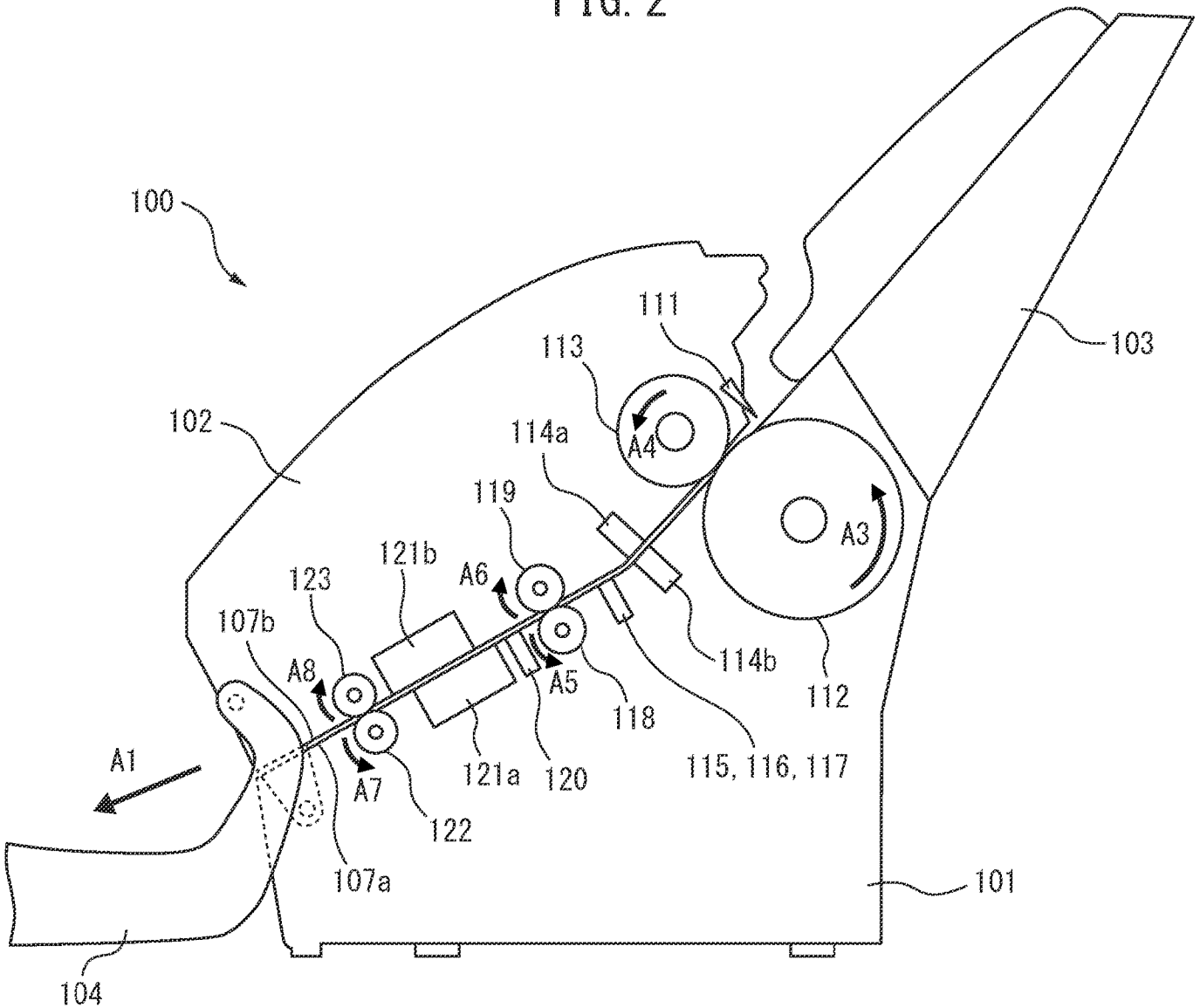
FIG. 2 is a diagram for illustrating a conveyance path inside the multi-feed detection apparatus 100.

FIG. 2 is a diagram for illustrating a conveyance path inside the multi-feed detection apparatus 100.

The conveyance path inside the multi-teed detection apparatus 100 includes a first medium sensor 111, a feed roller 112, a brake roller 113, an ultrasonic transmitter 114*a*, an ultrasonic receiver 114*b*, a second medium sensor 115, a first side sensor 116, a second side sensor 117, a first conveyance roller 118, a second conveyance roller 119, a third medium sensor 120, a first imaging device 121*a*, a second imaging device 121*b*, a third conveyance roller 122 and a fourth conveyance roller 123, etc. The numbers of each roller is not limited to one, and may be plural.

A top surface of the lower housing 101 forms a lower guide 107*a* of a conveyance path of a medium, and a bottom surface of the upper housing 102 forms an upper guide 107*b* of the conveyance path of a medium. An arrow A1 in FIG. 2 indicates a medium conveying direction. An upstream hereinafter refers to an upstream in the medium conveying direction A1, and a downstream refers to a downstream in the medium conveying direction A1.

The first medium sensor 111 includes a contact detection sensor and detects whether or not a medium is placed on the medium tray 103. The first medium sensor 111 generates and outputs a first detection signal changing the signal value between a state in which a medium is placed on the medium tray 103 and a state in which a medium is not placed.

The feeding roller 112 and the brake roller 113 are examples of a feed module, and feeds by separating the medium placed on the medium tray 103.

The ultrasonic transmitter 114*a* and the ultrasonic receiver 114*b* are examples of an ultrasonic transmission module and an ultrasonic reception module, respectively. The ultrasonic transmitter 114*a* and the ultrasonic receiver 114*b* are provided on the downstream side of the feed roller 112 and the brake roller 113, and also on the upstream side of the first conveyance roller 118 and the second conveyance roller 119, i.e., on the upstream side of the first imaging device 121*a* and the second imaging device 121*b*. The ultrasonic transmitter 114*a* and the ultrasonic receiver 114*b* are located close to the conveyance path of the medium in such a way as to face one another with the conveyance path in between. The ultrasonic transmitter 114*a* outputs an ultrasonic wave. On the other hand, the ultrasonic receiver 114*b* receives an ultrasonic wave being transmitted by the ultrasonic transmitter 114*a* and passing through a medium, and generates and outputs an ultrasonic signal being an electric signal corresponding to the received ultrasonic wave. The ultrasonic transmitter 114*a* and the ultrasonic receiver 114*b* may be hereinafter collectively referred to as an ultrasonic sensor 114.

The second medium sensor 115 is located downstream side of the ultrasonic sensor 114 and upstream side of the first conveyance roller 118 and the second conveyance roller 119 in the medium conveying direction A1. The second medium sensor 115 is located in the central portion in a direction A2 (see FIG. 1) perpendicular to the medium conveying direction. For example, when two feeding rollers 112 are located in the direction A2 perpendicular to the medium conveying direction, the second medium sensor 115 is located inside the outer ends of the two feeding rollers 112 in the direction A2 perpendicular to the medium conveying direction.

The second medium sensor 115 detects whether or not the medium exists at the second medium sensor 115. The second medium sensor 115 includes a light emitter and a light receiver provided on one side with respect to the conveyance path of the medium, and a reflection member such as a mirror provided at a position facing the light emitter and the light receiver across the conveyance path. The light emitter emits light toward the conveyance path. On the other hand, the light receiver receives light emitted by the light emitter and reflected by the reflection member, and generates and outputs a second detection signal being an electric signal based on intensity of the received light, since the light emitted by the light emitter is shielded by the medium when the medium exists at the position of the second medium sensor 115, the signal value of the second detection signal is changed in a state in which a medium exists at the position of the second medium sensor 115 and a state in which a medium does not exist at the position. The light emitter and the light receiver may be provided at positions facing one another with the conveyance path in between, and the reflection member may be omitted.

The first side sensor 116 and the second side sensor 117 are located downstream side of the ultrasonic sensor 114 in the medium conveying direction A1, and upstream side of the first conveyance roller 118 and the second conveyance roller 119. In particular, the first side sensor 116 and the second side sensor 117 are located at substantially the same position as the second medium sensor 115 in the medium conveying direction A1. The first side sensor 116 and the second side sensor 117 are located outside of the second medium sensor 115 and on both sides of the second medium sensor 115 in the direction A2 perpendicular to the medium conveying direction. In particular, the first side sensor 116 and the second side sensor 117 are located at positions away from ½ of a length (85.6 mm) of a long side of the ID card defined by ISO/IEC 7810 outer from the second medium sensor 115, respectively. Further, the first side sensor 116 and the second side sensor 117 are located at positions within ½ of a length (148 mm) of a long side of the A6 size paper outer from the second medium sensor 115, respectively.

The first side sensor 116 and the second side sensor 117 has the same configuration as the second medium sensor 115, respectively, to detect whether or not the medium exists at the position. The first side sensor 116 and the second side sensor 117 generates and outputs a first side signal and a second side signal being an electrical signal corresponding to the intensity of the light received by the light receiver, respectively.

The first conveyance roller 118 and the second conveyance roller 119 are provided on the downstream side of the second medium sensor 115 in the medium conveying direction A1, that is, on the downstream side of the feed roller 112 and the brake roller 113 in the medium conveying direction A1. The first conveyance roller 118 and the second conveyance roller 119 are provided on the upstream side of the third medium sensor 120 in the medium conveying direction A1, that is, on the upstream side of the first imaging device 121*a* and the second imaging device 121*b* in the medium conveying direction A1. The first conveyance roller 118 and the second conveyance roller 119 are examples of a conveyance module, and convey the medium fed by the feeding roller 112 and the brake roller 113, toward the first imaging device 121*a* and the second imaging device 121*b*.

The first imaging device 121*a* includes a reduction optical system type line sensor including an imaging element based on charge coupled devices (CCDs) linearly located in a main scanning direction. Further, the first imaging device 121*a* includes a lens for forming an image on the imaging element, and an A/D converter for amplifying and analog-digital (A/D) converting an electric signal output from the imaging element. The first imaging device 121*a* generates and outputs an input image acquired by imaging a back side of the conveyed medium.

Similarly, the second imaging device 121*b* includes a reduction optical system type line sensor including an imaging element based on CCDs linearly located in a main scanning direction. Further, the second imaging device 121*b* includes a lens for forming an image on the imaging element, and an A/D converter for amplifying and A/D converting an electric signal output from the imaging element. The second imaging device 121*b* generates and outputs an input image acquired by imaging a front side of the conveyed medium.

Only either of the first imaging device 121*a* or the second imaging device 121*b* may be located in the multi-feed detection apparatus 100 and only one side of a medium may be read. Further, a unity-magnification optical system type contact image sensor (CIS) including an imaging element based on a complementary metal oxide semiconductor (CMOS) may be used in place of the imaging element based on CCDs. Hereinafter, the first imaging device 121*a* and the second imaging device 121*b* may be collectively referred to as an imaging device 121.

A medium placed on the medium tray 103 is fed between the lower guide 107*a* and the upper guide 107*b* in the medium conveying direction A1 by the teed roller 112 rotating in a direction of an arrow A3 in FIG. 2. When a medium is fed, the brake roller 113 rotates in a direction of an arrow A4. By the workings of the feed roller 112 and the brake roller 113, when a plurality of media are placed on the medium tray 103, only a medium in contact with the feed rollers 112, out of the media placed on the medium tray 103, is separated. Consequently, the multi-feed detection apparatus 100 operates in such a way that feeding of a medium other than the separated medium is restricted (prevention of multi-feed).

The medium is fed between the first conveyance rollers 118 and the second conveyance rollers 119 while being guided by the lower guide 107*a* and the upper guide 107*b*. The medium is fed between the first imaging device 121*a* and the second imaging device 121*b* by the first conveyance roller 118 and the second conveyance roller 119 rotating in directions of arrows A5 and A6, respectively. The medium read by the imaging device 121 is ejected on the ejection tray 104 by the third conveyance roller 122 and the fourth conveyance roller 123 rotating in directions of arrows A7 and A8, respectively.

Figure 3:
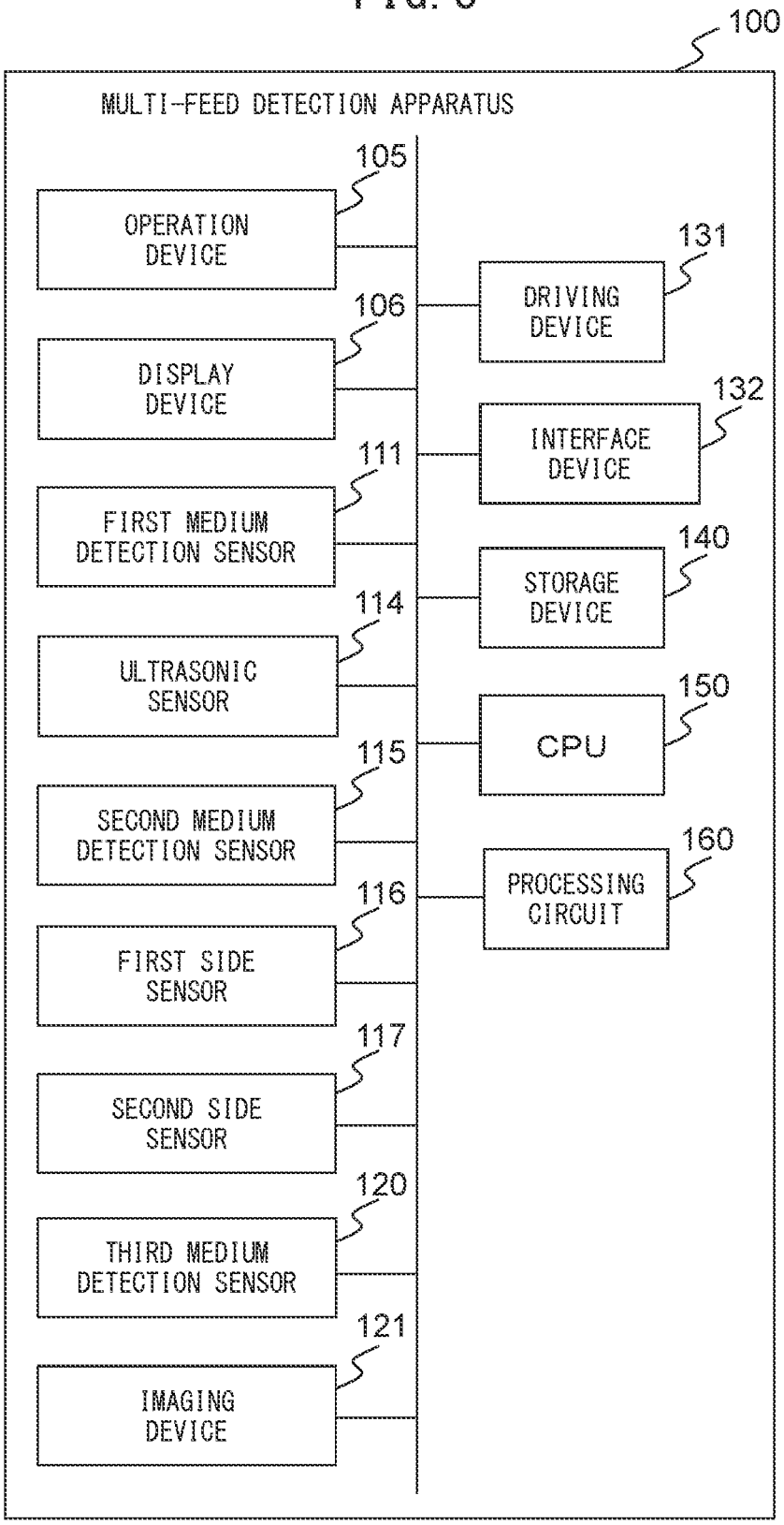
FIG. 3 is a block diagram illustrating a schematic configuration of the multi-feed detection apparatus 100.

FIG. 3 is a block diagram illustrating a schematic configuration of a multi-feed detection apparatus 100.

The multi-feed detection apparatus 100 further includes a driving device 131, an interface device 132, a storage device 140, a CPU (Central Processing Unit) 150 and a processing circuit 160, etc., in addition to the configuration described above.

The driving device 131 includes one or a plurality of motors, and conveys a medium by rotating the feed roller 112, the brake roller 113, the first conveyance roller 118, the second conveyance roller 119, the third conveyance roller 122 and the fourth conveyance roller 123, by a control signal from the CPU 150.

For example, the interface device 132 includes an interface circuit conforming to a serial bus such as universal serial bus (USB), is electrically connected to an unillustrated information processing device (for example, a personal computer or a mobile information terminal), and transmits and receives an input image and various types of information. Further, a communication device including an antenna transmitting and receiving wireless signals, and a wireless communication interface device for transmitting and receiving signals through a wireless communication line in conformance with a predetermined communication protocol may be used in place of the interface device 132. For example, the predetermined communication protocol is a wireless local area network (LAN).

The storage device 140 includes a memory device such as a random access memory (RAM) or a read only memory (ROM), a fixed disk device such as a hard disk, or a portable storage device such as a flexible disk or an optical disk. The storage device 140 stores a computer program, a database, a table, etc., used for various processing in the multi-feed detection apparatus 100. The computer program may be installed on the storage device 140 from a computer-readable, non-transitory medium such as a compact disc read only memory (CD-ROM), a digital versatile disc read only memory (DVD-ROM), etc., by using a well-known setup program, etc.

The CPU 150 operates in accordance with a program previously stored in the storage device 140. The processing circuit 150 may be a digital signal processor (DSP), a large scale integration (LSI), an application specific integrated circuit (ASIC), a field-programmable gate array (FPGA), etc.

The CPU 150 is connected to the operating device 105, the display device 106, the first medium sensor 111, the ultrasonic sensor 114, the second medium sensor 115, the first side sensor 116, the second side sensor 117, the third medium sensor 120, the imaging device 121, the driving device 131, the interface device 132, the storage device 140 and the processing circuit 160, etc., to control each module. The CPU 150 performs the drive control of the drive device 131, imaging control of the imaging device 121, etc., acquires an image, and transmits it to the information processing apparatus (not shown) through the interface device 132. Further, the CPU 150 detects the multi-feed of the fed medium based on the ultrasonic signal generated by the ultrasonic sensor 114 and returns the multi-fed medium to a direction of the medium tray 103.

The processing circuit 160 executes predetermined image processing on an image imaged by the imaging device 121 and stores the image on which the image processing is executed into the storage device 140. A DSP, an LSI, an ASIC, an FPGA, etc., may be used in place of the processing circuit 160.

Figure 4:
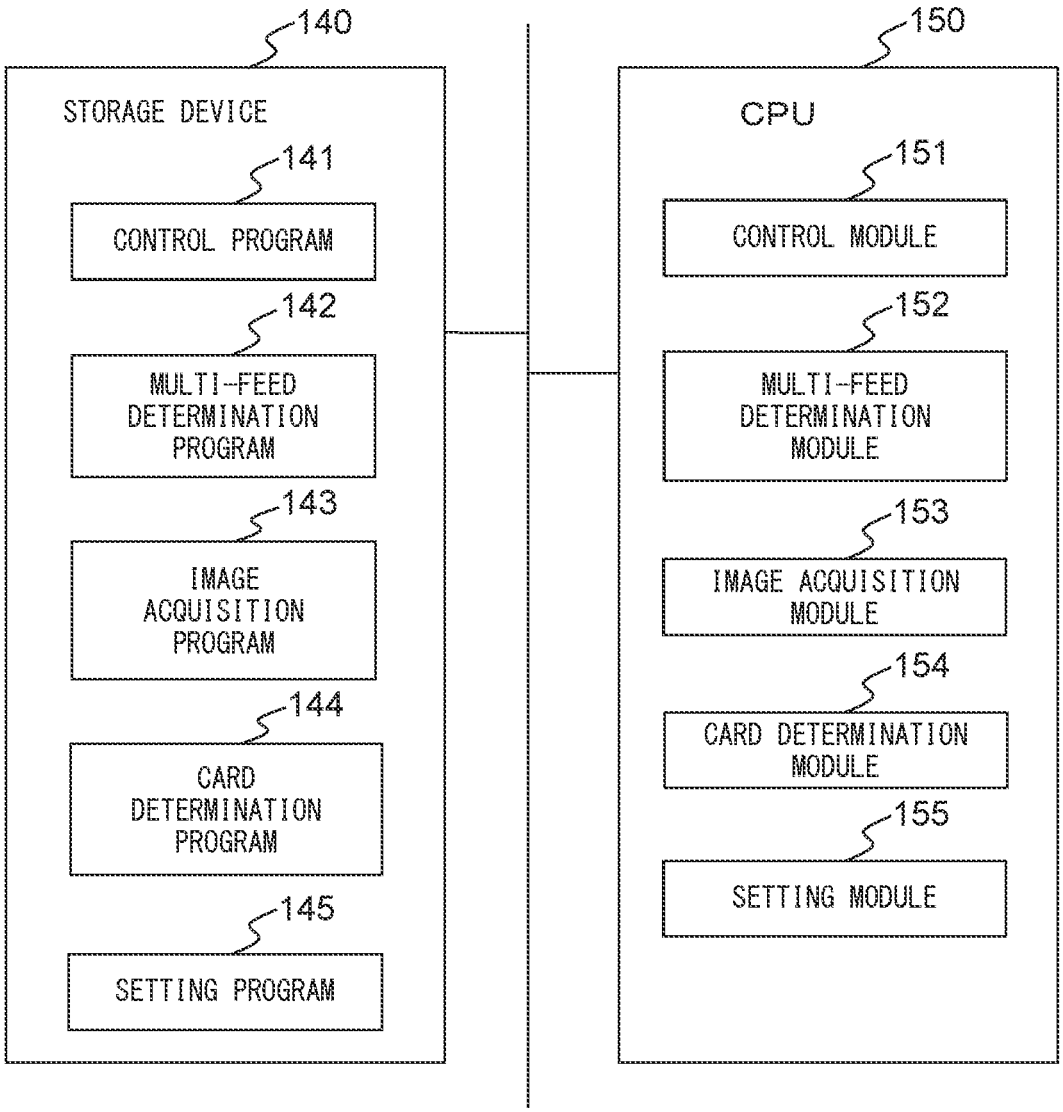
FIG. 4 is a diagram illustrating schematic configurations of a storage device 140 and a CPU 150.

FIG. 4 is a diagram illustrating schematic configurations of the storage device 140 and the processing circuit 150.

As illustrated in FIG. 4, the storage device 140 stores a control program 141, a multi-feed determination program 142, an image acquisition program 143, a card determination program 144 and a setting program 145, etc. Each of these programs is a functional module implemented by software operating on a processor. The processing circuit 150 reads each program stored in the storage device 140 and operates in accordance with each read program. Thus, the CPU 150 functions as a control module 151, a multi-feed determination module 152, an image acquisition module 153, a card determination module 154 and a setting module 155.

Figure 5:
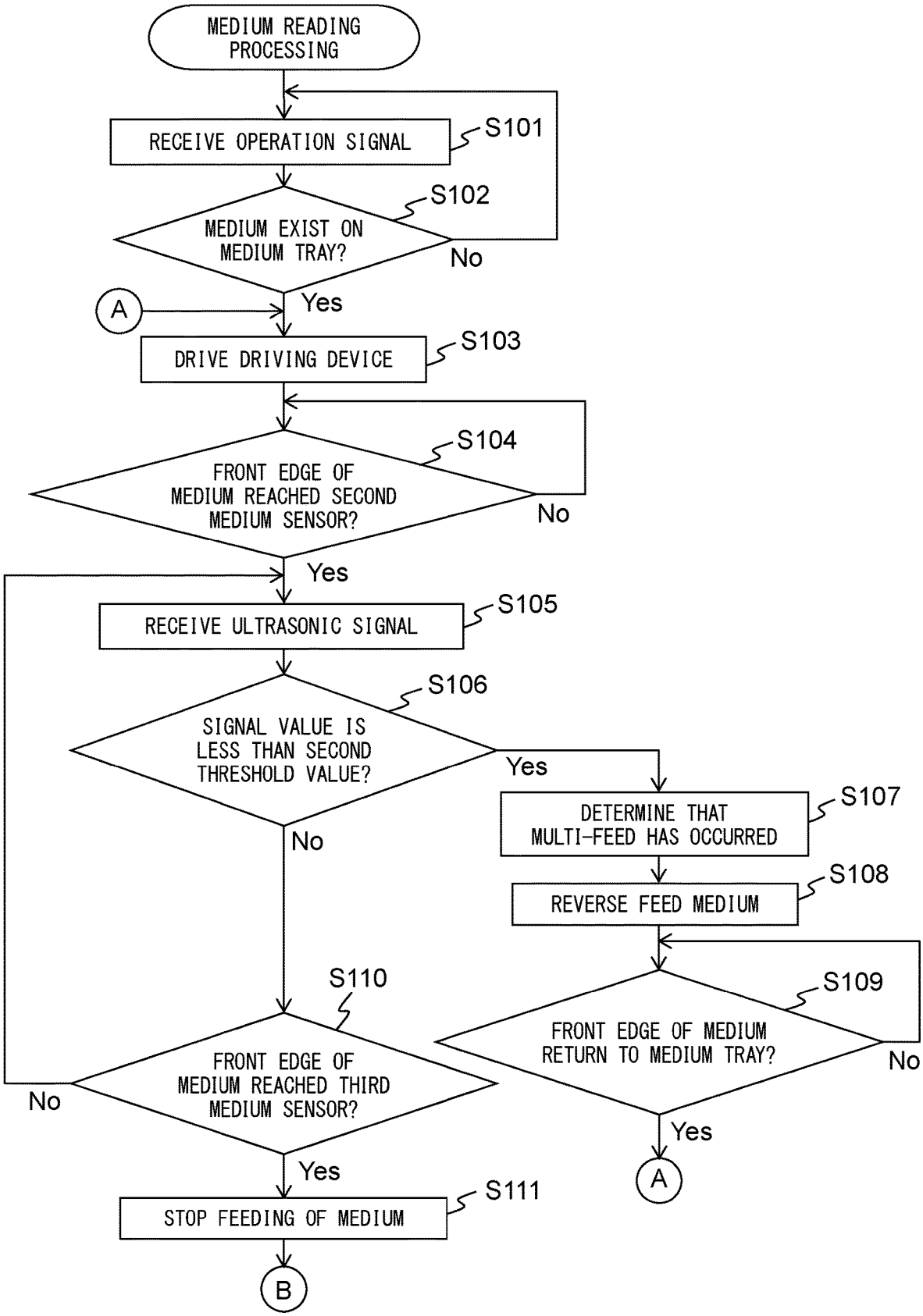
FIG. 5 is a flowchart illustrating an operation example of a medium reading processing.
Figure 6:
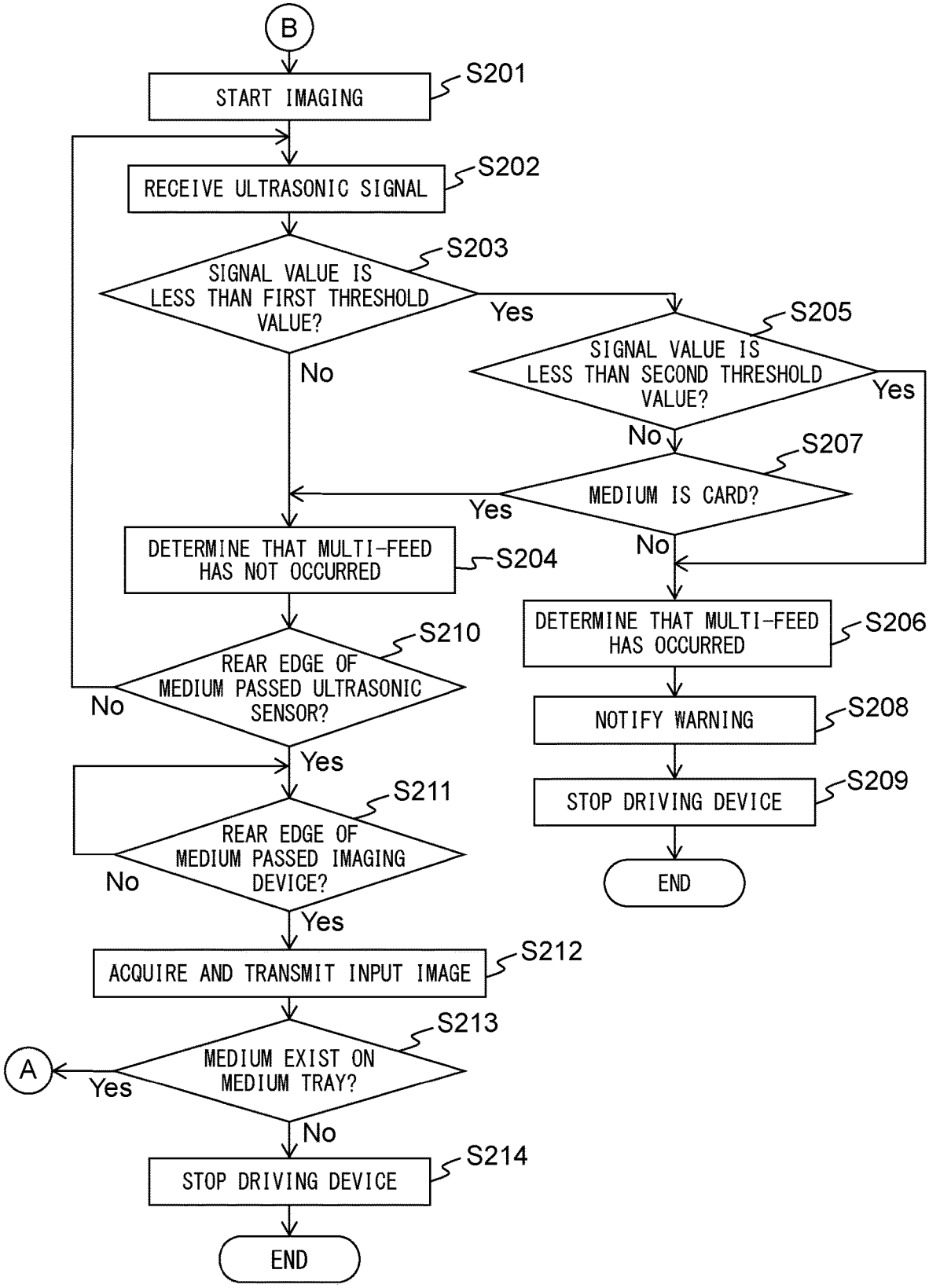
FIG. 6 is a flowchart illustrating an operation example of the medium reading processing.

FIGS. 5 and 6 are flowcharts illustrating an operation example of a medium reading processing in the multi-feed detection apparatus 100.

Referring to the flowchart illustrated in FIGS. 5 and 6, the operation example of the medium reading processing in the multi-feed detection apparatus 100 will be described below. The operation flow described below is executed mainly by the CPU 150 in cooperation with each element in the multi-feed detection apparatus 100, in accordance with a program previously stored in the storage device 140. The operation flow illustrated in FIG. 4 is periodically executed.

First, the control module 151 stands by until an instruction to read a medium is input by a user by use of the operation device 105, and an operation signal instructing to read the medium is received from the operation device 105 (step S101).

Next, the control module 151 determines whether or not a medium is placed on the medium tray 103 based on the first detection signal received from the first medium sensor 111 (step S102).

When a medium is not placed on the medium tray 103, the control module 151 returns the processing to step S101 and stands by until newly receiving an operation signal from the operation device 105.

On the other hand, when a medium is placed on the medium tray 103, the control module 151 drives the driving device 131, rotates the feed rollers 112, the brake rollers 113, and the first to fourth conveyance rollers 118, 119, 122, and 123, and feeds and conveys the medium (step S103). The control module 151 controls the feed roller 112 and the brake roller 113 to feed by separating the medium placed on the medium tray 103 by rotating the feed roller 112 in the direction A3 in which the medium is fed, and rotating the brake roller 113 in the direction A4 opposite to a direction in which the medium is fed. Further, the control module 151 controls the first to fourth conveyance rollers 118, 119, 122 and 123 to convey the fed medium by rotating the first to fourth conveyance rollers 118, 119, 122 and 123 in the directions A5, A6, A7 and A8 in which the medium is conveyed, respectively.

Next, the multi-feed determination module 152 waits until a front end of the medium reaches the position of the second medium sensor 115 (step S104). The multi-feed determination module 152 receives periodically the second detection signal from the second medium sensor 115, and determines whether or not the front end of the medium has reached the position of the second medium sensor 115, based on the received second detection signal. The multi-feed determination module 152 determines that the front end of the medium has reached the position of the second medium sensor 115 when the signal value of the second detection signal changes from a value indicating that the medium does not exist to a value indicating that the medium exists.

Next, the multi-feed determination module 152 receives the ultrasonic signal from the ultrasonic sensor 114 when the front end of the medium has reached the position of the second medium sensor 115 (step S105).

Figure 7:
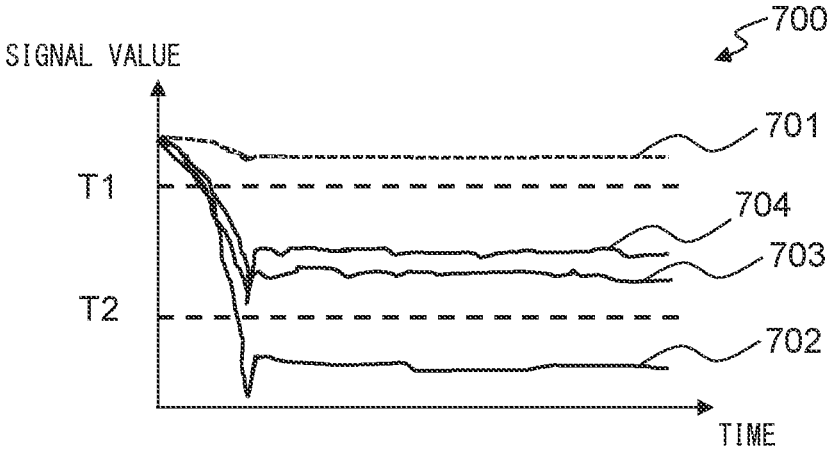
FIG. 7 is a schematic diagram for illustrating a characteristic of an ultrasonic signal.

FIG. 7 is a schematic diagram for illustrating a characteristic of the ultrasonic signal.

The horizontal axis of graph 700 in FIG. 7 indicates time, and the vertical axis indicates a signal value of the ultrasonic signal. In the graph 700, a line 701 indicates the characteristic of the ultrasound signal when a sheet of PPC (Plain Paper Copier) paper is fed as a medium. A line 702 indicates the characteristics of the ultrasonic signal when the multi-feed of the PPC paper is occurring. Due to occurrence of the multi-feed, the signal value of the ultrasonic signal in the line 702 declines. A line 703 indicates the characteristics of the ultrasonic signal when the multi-feed of a thin paper thinner than the PPC paper is occurring. A thin paper is a medium that is easy to bend and have a damage, such as a paper for clause, and has a thickness less than a predetermined thickness (e.g., a metric basis weight less than 40 [g/m2]). Hereinafter, a paper other than a thin paper, that is, a paper whose thickness is equal to or more than the predetermined thickness, may be referred to as a non-thin paper. The signal value of the ultrasonic signal when the multi-feed of thin paper is occurring is larger than the signal value of the ultrasonic signal when the multi-feed of non-thin paper is occurring, but is smaller than the signal value of the ultrasonic signal when a single non-thin paper is fed.

Therefore, the multi-feed detection apparatus 100 can determine whether or not the multi-feed of the medium is occurring, by setting a first threshold T1 between the signal value of the ultrasonic signal when the single non-thin paper is fed and the signal value of the ultrasonic signal when the multi-feed of the thin paper is occurring. Further, the multi-feed detection apparatus 100 can determine whether the medium fed by the multi-teed is a non-thin paper or a thin paper, by setting a second threshold T2 between the signal value of the ultrasonic signal when the multi-feed of the thin paper is occurring and the signal value of the ultrasonic signal when the multi-feed of the non-thin paper is occurring.

A line 704 indicates the characteristics of the ultrasound signal when only one plastic ID card is fed. When the card is fed, the signal value of the ultrasonic signal declines, as is the case when the multi-feed is occurring. Furthermore, the signal value of the ultrasonic signal when the card is fed is close to the signal value of the ultrasonic signal when the multi-feed of the thin papers is occurring, and it is difficult to determine whether the card is conveyed or the multi-feed of the thin paper is occurring based on the ultrasonic signal.

Next, the multi-feed determination module 152 determines whether or not the signal value of the received ultrasonic signal is less than the second threshold value (step S106). The second threshold value is set to a value smaller than the first threshold value for determining whether or not the multi-feed of the medium has occurred.

When the signal value of the ultrasonic signal is less than the second threshold value, the multi-feed determination module 152 determines that the multi-feed of the medium, in particular, the multi-feed of the non-thin paper has occurred (step S107).

Next, the control module 151 drives the driving device 131 to rotate the feeding roller 112 and the brake roller 113 in a direction opposite to the medium feeding direction to reversely feed the fed medium toward the medium tray 103 (step S108). The control module 151 controls the feed roller 112 and the brake roller 113 to return the fed medium to the direction of the medium tray 103, by rotating the feed roller 112 in the direction opposite to the direction A3 in which the medium is fed, and by rotating the brake roller 113 in the direction 44 opposite to the direction in which the medium is fed.

Thus, the control module 151 returns the fed medium to the direction of the medium tray 103 when the signal value of the ultrasonic signal is less than the second threshold value. That is, the control module 151 returns the media to the direction of the medium tray 103 when the fed media are a plurality of non-thin papers. Thus, the user does not need to reload the medium fed by the multi-feed to the medium tray 103, the multi-feed detection device 100 can improve the convenience of the user. Further, when the fed medium is a single sheet of paper or a card, the control module 151 does not return the medium to the medium tray 103. Thus, the multi-feed detection apparatus 100 can prevent the processing time of the medium reading processing from being increased. The control module 151 does not return the medium to the medium tray 103 even when the fed media are two sheets of non-thin papers. Thus, the multi-feed detection apparatus 100 can prevent occurrence of a damage or a jam, etc., of the medium.

Next, the control module 151 waits until the front end of the medium passes through the nip position of the feed roller 112 and the brake roller 113 and returns to the medium tray 103 (step S109). The control module 151 periodically receives the second detection signal from the second medium sensor 115, and determines whether or not the front end of the medium has passed through the position of the second medium sensor 115, based on the received second detection signal. The control module 151 determines that the front end of the medium has passed through the position of the second medium sensor 115 when the signal value of the second detection signal changes from the value indicating that a medium exists to the value indicating that a medium does not exist. The control module 151 determines that the front end of the medium has passed through the nip position of the feed roller 112 and the brake roller 113, and returned to the medium tray 103 when a predetermined time has elapsed since the front end of the medium passed through the position of the second medium sensor 115. The predetermined time is set in advance at a time when the medium moves from the position of the second medium sensor 115 to the nip position of the feed roller 112 and the brake roller 113.

When the front end of the medium has passed through the nip positions of the feeding roller 112 and the brake roller 113 and returned to the medium tray 103, the control module 151 returns the process to step S103, and causes the feeding roller 112 and the brake roller 113 to re-feed the medium returned to the medium tray 103.

Figure 8A:
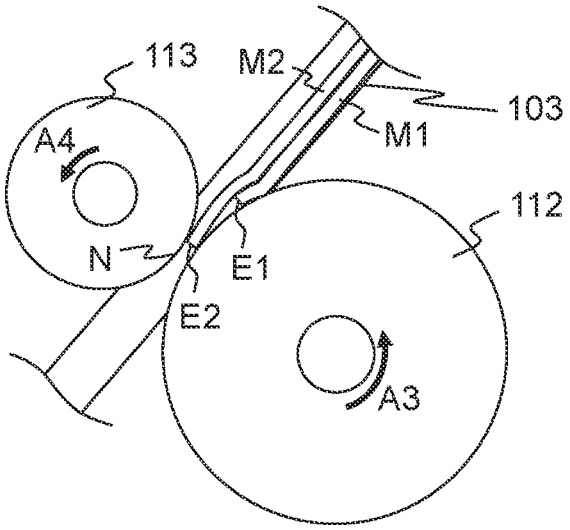
FIG. 8A is a schematic diagram for illustrating re-feeding of a medium.
Figure 8B:
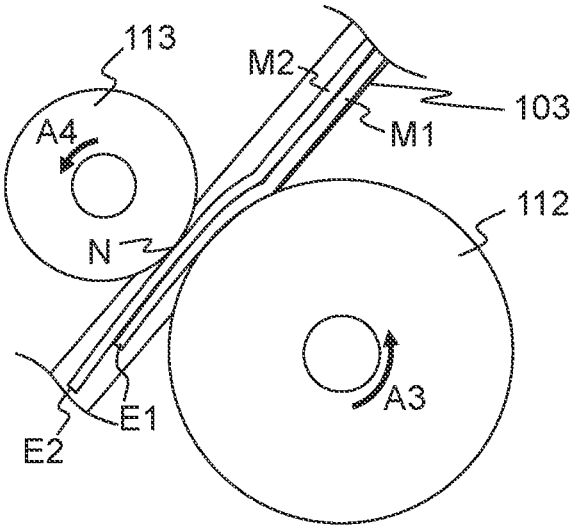
FIG. 8B is a schematic diagram for illustrating the re-feeding of the medium.
Figure 8C:
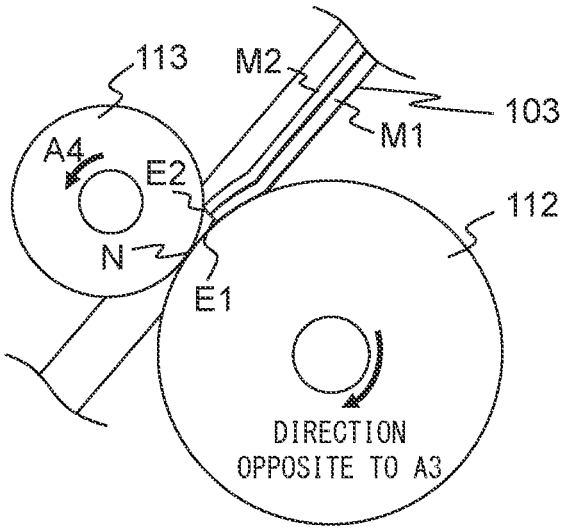
FIG. 8C is a schematic diagram for illustrating the re-feeding of the medium.

FIGS. 8A, 8B and 8C are schematic diagrams for illustrating the re-feeding of the medium.

FIGS. 8A, 8B and 8C schematically illustrate a movement of the re-fed medium. FIG. 8A illustrates a state in which a plurality of media M1 and M2 are placed on the medium tray 103 in a state in which front ends E1 and E2 are not aligned, in particular, a state in which the front end E2 of the medium M2 on the brake roller 113 side (the upper side) is positioned the downstream side of the front end E1 of the medium M1 on the feeding roller 112 side (the lower side). In this case, the front end E2 of the medium M2 reaches the nip position N of the feed roller 112 and the brake roller 113 prior to the front end E1 of the medium M1, and the medium M2 passes through the nip position N. On the other hand, the medium M1 is in contact with the feeding roller 112 and is fed toward the downstream side by the feeding roller 112. Thus, as illustrated in FIG. 8B, the media M1 and M2 are fed by multi-feed. Thus, when the front ends E1 and E2 of the plurality of media M1 and M2 are not aligned, there is a high possibility that a multi-feed occurs.

Thereafter, when the feed roller 112 rotates in the opposite direction of A3 in which the medium is fed, and the brake roller 113 rotates in the direction A4 opposite to the direction in which the media is fed, the media M1 and M2 fed by the multi-feed return to the medium tray 103 while being sandwiched between the feed roller 112 and the brake roller 113. Each medium M1 and the medium M2 is not sandwiched between the feed roller 112 and the brake roller 113, and stops when passing through the nip position N. Thus, as illustrated in FIG. 8C, the front end E1 of the medium M1 and the front end E2 of the medium M2 returned to the medium tray 103 are aligned at a position in front of the nip position N. Therefore, when the medium returned to the medium tray 103 is re-fed, the possibility that the multi-feed occurs is reduced.

In step S106, when the signal value of the ultrasonic signal is equal to or more than the second threshold value, the multi-feed determination module 152 determines whether or not the front end of the medium has reached the position of the third medium sensor 120 (step S110). The multi-feed determination module 152 receives periodically the third detection signal from the third medium sensor 120, and determines whether or not, the front end of the medium has reached the position of the third medium sensor 120, based on the received third detection signal. The multi-feed determination module 152 determines that the front end of the medium has reached the position of the third medium sensor 120 when the signal value of the third detection signal changes from the value indicating that the medium does not exist to the value indicating that the medium exists.

When the front end of the medium has not reached the position of the third medium sensor 120, the multi-feed determination module 152 returns the process to step S105, and repeats processes of steps S105 to S110. Thus, the multi-feed determination module 152 continues the determination of the multi-feed until the front end of the fed medium passes through the first conveyance roller 118 and the second conveyance roller 119, and the control module 151 returns the medium to the direction of the medium tray 103 when the multi-feed of the non-thin paper occurs.

On the other hand, when the front end of the medium has reached the position of the third medium sensor 120, the control module 151 stops the rotation of the feed roller 112 and the brake roller 113, to stop the feeding of the medium (step S111). The medium fed by the feeding roller 112 and the brake roller 113 is thereafter conveyed by the first to fourth conveyance rollers 118, 119, 122, and 123.

Next, the image acquisition module 153 causes the imaging device 121 to start imaging the fed medium (step S201).

Next, the multi-feed determination module 152 receives the ultrasonic signal from the ultrasonic sensor 114 (step S202).

Next, the multi-feed determination module 152 determines whether or not the signal value of the received ultrasonic signal is less than the first threshold value (step S203).

When the signal value of the ultrasonic signal is equal to or more than the first threshold value, the multi-feed determination module 152 determines that the multi-feed of the medium has not occurred and that the conveyance of the medium is normal and continues the conveyance of the medium (step S204).

On the other hand, when the signal value of the ultrasonic signal is less than the first threshold value, the multi-feed determination module 152 further determines whether or not the signal value of the ultrasonic signal is less than the second threshold value (step S205).

When the signal value of the ultrasonic signal is less than the second threshold value, the multi-feed determination module 152 determines that the multi-feed of the medium, in particular, the multi-feed of the non-thin paper, has occurred (step S206).

On the other hand, when the signal value of the ultrasonic signal is equal to or more than the second threshold value, that is, when the signal value of the ultrasonic signal is less than the first threshold value and is equal to or more than the second threshold value, the card determination module 154 determines whether or not the fed medium is a card (step S207). The card determination module 154 receives periodically the second detection signal, the first side signal and the second side signal from the second medium sensor 115, the first side sensor 116 and the second side sensor 117, and determines whether or not the fed media fed is the card based on each received signal. When the signal value of each signal changes from the value indicating that a medium does not exist to the value indicating that a medium exists, the card determination module 154 determines that the front end of the medium has passed through the sensor that has generated each signal.

When the front end of the medium does not pass through both the first and second side sensors 116 and 117 when the front end of the medium passes through the second medium sensor 115, the card determination module 154 determines that the medium is smaller than the distance between the first side sensor 116 and the second side sensor 117 and is a card. On the other hand, when the front end of the medium passes through any of the first and second side sensors 116 and 117 when the front end of the medium passes through the second medium sensor 115, the card determination module 154 determines that the medium is larger than the distance between the first side sensor 116 and the second side sensor 117 and is not a card.

The card determination module 154 may determine whether or not the medium is a card by another method. For example, the card determination module 154 determines whether or not the medium is a card based on the image captured by the imaging device 121. In that case, the card determination module 154 acquires a line image in which an area (line) facing the line sensor in the medium is imaged from the imaging device 121. The card determination module 154 detects an edge pixel from the line image, using a known image processing technique, and detects an area sandwiched between an edge pixel detected on the leftmost side and an edge pixel detected on rightmost side as a medium area. The card determination module 154 determines whether or not the medium is a card based on whether or not the number of pixels of the detected medium area is equal to or less than a predetermined number. The predetermined number is set to a value acquired by adding a margin to the number of pixels corresponding to the length of the long side of the ID-card defined by ISO/IEC 7810.

Further, the card determination module 154 may determine whether or not the medium is a card based on a thickness of the medium. For example, the multi-feed detection apparatus 100 may include a reflected light sensor, a pressure sensor, or a mechanical sensor. The reflected light sensor detects a time from when it emits light on a surface of the medium until it receives reflected light, and the card determination module 154 detects the thickness of the medium according to the detected time. The pressure sensor detects a pressure that varies according to the thickness of the medium, and the card determination module 154 detects the thickness of the medium by the detected pressure. The mechanical sensor detects an amount of movement of a roller in contact with the medium, and the card determination module 154 detects the thickness of the medium by the detected amount of movement. The card determination module 154 determines whether or not the medium is a card based on whether or not the detected thickness of the medium is equal to or more than a predetermined thickness. The predetermined thickness is set to a value (e.g., 0.5 mm) between the thickness of the general ID card and the thickness of the PPC paper.

When the fed medium is a card, the control module 151 determines that the multi-feed of the medium has not occurred and that the conveyance of the medium is normal, and continues to convey the medium (step S204). Thus, the multi-feed detection apparatus 100 prevents the conveyance of the medium from being stopped when the card is fed, and as a result, prevents the processing time of the medium read processing from being increased.

On the other hand, when the fed medium is not a card, the control module 151 determines that the multi-feed of the medium, in particular, the multi-feed of the thin paper, has occurred (step S206).

Next, the control module 151 notifies a user of a warning (S208 of steps). The control module 151 displays the information indicating that the multi-feed of the medium has occurred on the display device 106 or transmits the information to the information processing device (not shown) through the interface device 132 to notify the user of the warning. Thus, the user can recognize that the multi-feed of the medium has occurred, the thin paper can be safely taken out by his own hand from the multi-feed detection apparatus 100 and re-placed on the medium tray 103.

Next, the control module 151 stops conveying the medium by stopping the drive device 131, and terminates the imaging by the imaging device 121 (step S209), and ends the series of steps.

Thus, the control module 151 does not return the fed medium to the direction of medium tray 103 after the front end of the fed medium has passed through the first conveyance roller 118 and the second conveyance roller 119, even when the multi-feed of the medium has occurred. After the front end of the medium has passed through the first conveyance roller 118 and the second conveyance roller 119, the medium is conveyed by sandwiching between the first conveyance roller 118 and the second conveyance roller 119. Therefore, the structure or the control of the first conveyance roller 118 and the second conveyance roller 119 for returning the medium to the direction of the medium tray 103 by the feed roller 112 and the brake roller 113, are complicated. When the multi-feed occurs after the front end of the medium passes through the first conveyance roller 118 and the second conveyance roller 119, the multi-feed detection apparatus 100 causes the user to safely take out the medium in which the multi-feed occurs, thereby prevents the occurrence of the damage to the medium.

On the other hand, when the signal value of the ultrasonic signal is equal to or more than the first threshold value or the medium fed is the card and the conveyance of the medium is continued in step S204, the multi-feed determination module 152 determines whether or not the rear end of the medium has passed through the ultrasonic sensor 114 (step S210). The multi-feed determination module 152 periodically receives the second detection signal from the second medium sensor 115, and determines whether or not the rear end of the medium has passed through the position of the second medium sensor 115, based on the received second detection signal. The multi-feed determination module 152 determines that the rear end of the medium has passed through the position of the second medium sensor 115, and has passed through the ultrasonic sensor 114 when the signal value of the second detection signal changes from the value indicating that the medium exists to the value indicating that the medium does not exist.

When the rear end of the medium has not passed through the ultrasonic sensor 114, the multi-feed determination module 152 returns the process to step S202 and repeats the processes of steps S202 to S210. Thus, the multi-feed determination module 152 continues the determination of the multi-feed even after the front end of the fed medium has passed through the first conveyance roller 118 and the second conveyance roller 119. Therefore, the multi-feed determination module 152 can determine that the multi-feed of the medium has occurred, not only for the media conveyed with the overlapped front ends, but also for the medium overlapped in a state in which the front ends are not aligned, or for the medium to which the sticker paper, etc., is attached.

On the other hand, when the rear end of the medium has passed through the ultrasonic sensor 114, the image acquisition module 153 determines whether or not the rear end of the medium has passed through the imaging device 121 (step S211). The image acquisition module 153 periodically receives the third detection signal from the third medium sensor 120, and determines whether or not the rear end of the medium has passed through the position of the third medium sensor 120, based on the received third detection signal. The image acquisition module 153 determines that the rear end of the medium has passed through the position of the third medium sensor 120 when the signal value of the third detection signal changes from the value indicating that a medium exists to a value indicating that a medium does not exist. The image acquisition module 153 determines that the rear end of the medium has passed through the imaging device 121 when a predetermined time has elapsed since the rear end of the medium has passed through the position of the third medium sensor 120. The predetermined time is set in advance to a time when the medium moves from the position of the third medium sensor 120 to the imaging device 121.

When the rear end of the medium has passed through the imaging device 121, the image acquisition module 153 acquires an input image from the imaging device 121, and transmits the acquired input image to the information processing apparatus (not shown) through the interface device 132 (step S212). Further, the image acquisition module 153 terminates the imaging by the imaging device 121. When not being connected to the information processing device, the image acquisition module 153 stores the input image in the storage device 140.

Next, the control module 151 determines whether or not a medium remains on the medium tray 103 based on the first detection signal received from the first medium sensor 111 (step S213). When a medium remains on the medium tray 103, the control module 151 returns the process to step S103 and repeats the processes in steps S103 to S213.

On the other hand, when a medium does not remain on the medium tray 103, the control module 151 stops the driving device 131 (step S214) and ends the series of steps.

The multi-feed determination module 152 may determine whether or not the signal value of the ultrasonic signal is equal to or more than the first threshold value, prior to the process of step S106 to S107. In that case, the multi-feed determination module 152 determines that the feeding of the medium is normal when the signal value of the ultrasonic signal is equal to or more than the first threshold value, the multi-teed determination module 152 determines that the multi-feed of the medium has occurred when the signal value of the ultrasonic signal is less than the first threshold value. Then, the multi-feed determination module 152 determines whether or not the signal value of the ultrasonic signal is less than the second threshold value in step S106 only when the multi-feed determination module 152 determines that the multi-feed of the medium has occurred.

Further, in the process of step S108 to S109, the control module 151 may ends the series of steps without re-feeding the medium when the control module 151 returns the medium to the medium tray 103. Even in that case, the user does not need to reload the medium to the medium tray 103, the multi-feed detection device 100 can improve the convenience of the user.

Further, the processes of step S205, S207 may be omitted, and the multi-feed determination module 152 may determine that the multi-feed of the medium has occurred regardless of whether or not the fed medium is a card when the signal value of the ultrasonic signal is less than the first threshold value. Even in that case, the multi-teed detection apparatus 100 can suitably determine whether or not the multi-feed of the fed medium has occurred when a medium other than a card is fed.

Further, either of the process of step S208 or the process of step S209 may be omitted, and the control module 151 may execute only one of the processing of notifying the user of the warning or the processing of stopping conveying the medium.

Figure 9:
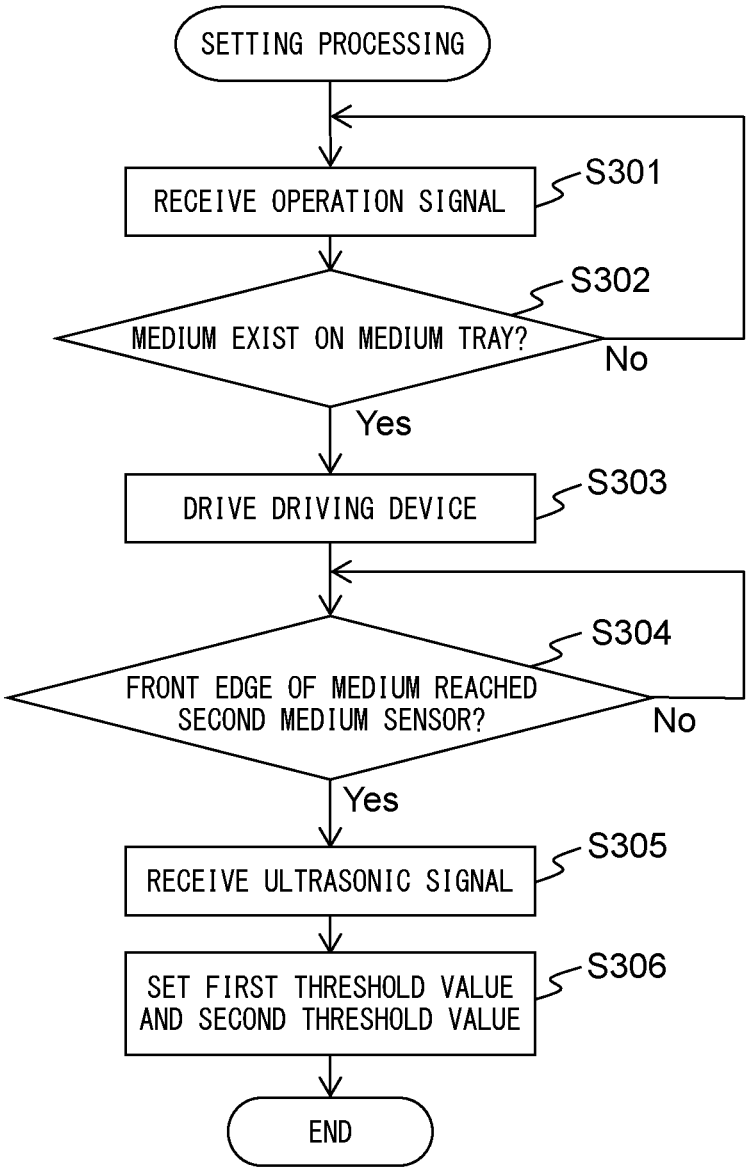
FIG. 9 is a flowchart illustrating an operation example of a setting processing.

FIG. 9 is a flowchart illustrating an operation example of a setting processing.

Hereinafter, an example of the operation of the setting process in the multi-feed detection apparatus 100 will be described with referring to the flowchart illustrated in FIG. 9. The operation flow described below is executed mainly by the CPU 150 in cooperation with each element in the multi-feed detection apparatus 100, in accordance with a program previously stored in the storage device 140.

First, the setting module 155 stands by a setting instruction of the first threshold value or the second threshold is input by a user by use of the operation device 105, and an operation signal corresponding to the setting instruction instructing is received from the operation device 105 (step S301), in the setting instruction, a type of the medium used in the setting processing is specified by the user. The specified type of the medium is either of one non-thin paper, one card, two thin papers or two non-thin papers. The user places the specified type of medium on the medium tray 103 among the medium to be normally used and inputs the setting instruction. The setting module 155 receives the setting instruction by the user when receiving the operation signal corresponding to the setting instruction from the operation device 105.

The setting module 155 executes the processes of step S302 to S304 in the same manner as the processes in step S102 to S104 of FIG. 5, and feeds the medium placed on the medium tray 103 when the setting module 155 receives the setting instruction by the user is received. When the type of the medium specified in the setting instruction is two non-thin papers or two thin papers, the control module 151 does not rotate the brake roller 113 in the direction A4 opposite to the direction in which the medium is fed, to feed the medium without separating the medium, in step S303.

Next, the setting module 155 receives the ultrasonic signal from the ultrasonic sensor 114 when the front end of the medium reaches the position of the second medium sensor 115 (step S305).

Next, the setting module 155 sets the first threshold value and the second threshold based on the received ultrasonic signal generated by the ultrasonic sensor 114 (step S306), and ends the series of steps. The setting module 155 sets a value acquired by multiplying a first coefficient to the signal value of the received ultrasonic signal as the first threshold value, and sets a value acquired by multiplying a second coefficient to the signal value of the received ultrasonic signal as the second threshold value. The second coefficient is set to a value smaller than the first coefficient.

When the type of the medium specified in the setting instruction is one non-thin paper, the first coefficient and the second coefficient are set to a value smaller than 1. For example, the first coefficient is set to 0.9 and the second coefficient is set to 0.4. On the other hand, when the type of the medium specified in the setting instruction is one card or two thin papers, the first coefficient is set to a value more than 1, and the second coefficient is set to a value less than 1. For example, the first coefficient is set to 1.2 and the second coefficient is set to 0.8. Further, when the type of the medium specified in the setting instruction is two non-thin papers, the first coefficient and the second coefficient are set to a value more than 1. For example, the first coefficient is set to 4.0 and the second coefficient is set to 2.0.

The multi-feed determination module 152 determines whether or not the multi-feed of the medium has occurred using the first threshold value and the second threshold value set by the setting module 155. Thus, the multi-feed detection apparatus 100 can suitably set the threshold value according to the medium actually used by the user, thereby improving the detection accuracy of the multi-feed and the determination accuracy of the thin paper.

The setting module 155 may set the first threshold and the second threshold by conveying the medium a plurality of times, rather than setting the first threshold value and the second threshold by conveying the medium only once. For example, the setting module 155 sets the first threshold value to a value between the signal value of the ultrasonic signal when one non-thin paper is conveyed and the signal value of the ultrasonic signal when one card or two thin papers is conveyed. The setting module 155 sets the second threshold value to a value between the signal value of the ultrasonic signal when one card or two thin papers is conveyed and the signal value of the ultrasonic signal when two non-thin papers are conveyed. Thus, the multi-feed detection apparatus 100 can set the threshold more suitably according to the medium used by the user. On the other hand, the multi-feed detection apparatus 100 can reduce the time and the effort of the user in the setting processing and improve the convenience of the user by setting the threshold by conveying the medium only once.

Further, in the setting processing, the setting module 155 may set only one of the first threshold and the second threshold, rather than setting both the first threshold value and the second threshold. Further, the setting module 155 sets a plurality of threshold values as the first threshold value and/or the second threshold value, respectively, and the multi-feed determination module 152 may receive an instruction for selecting the first threshold value and/or the second threshold value from the user before the medium reading processing is executed. The user can change the first threshold value and/or second threshold value depending on a scene of use, and flexibly change the medium to be carried out the processing of stopping conveying or the processing of returning to the medium tray 103 and the medium not to be carried out the processing.

As described in detail above, the multi-feed detection apparatus 100 determines that the multi-feed of the medium has occurred when the signal value of the ultrasound signal is less than the first threshold value, and assumes that the multi-feed of the non-thin paper has occurred and returns the medium to the direction of the medium tray 103 when the signal value of the ultrasound signal is less than the second threshold value. In other words, the multi-feed detection apparatus 100 uses the second threshold value for determining whether or not the multi-fed medium is a non-thin sheet to be returned to the direction of the medium tray 103 or a thin sheet not to be returned to the direction of the medium tray 103, in addition to the first threshold value for determining whether or not the multi-feed of the medium has occurred. Thus, the multi-feed detection apparatus 100 can suitably determine whether or not the multi-feed of the medium has occurred and whether or not the multi-fed medium is a non-thin paper or a thin paper, based on the ultrasonic signal generated by the ultrasonic sensor 114. Therefore, the multi-feed detection apparatus 100 can suitably determine whether or not the multi-feed detection apparatus returns the fed medium to the direction of the medium tray when the multi-feed has occurred.

Figure 10:
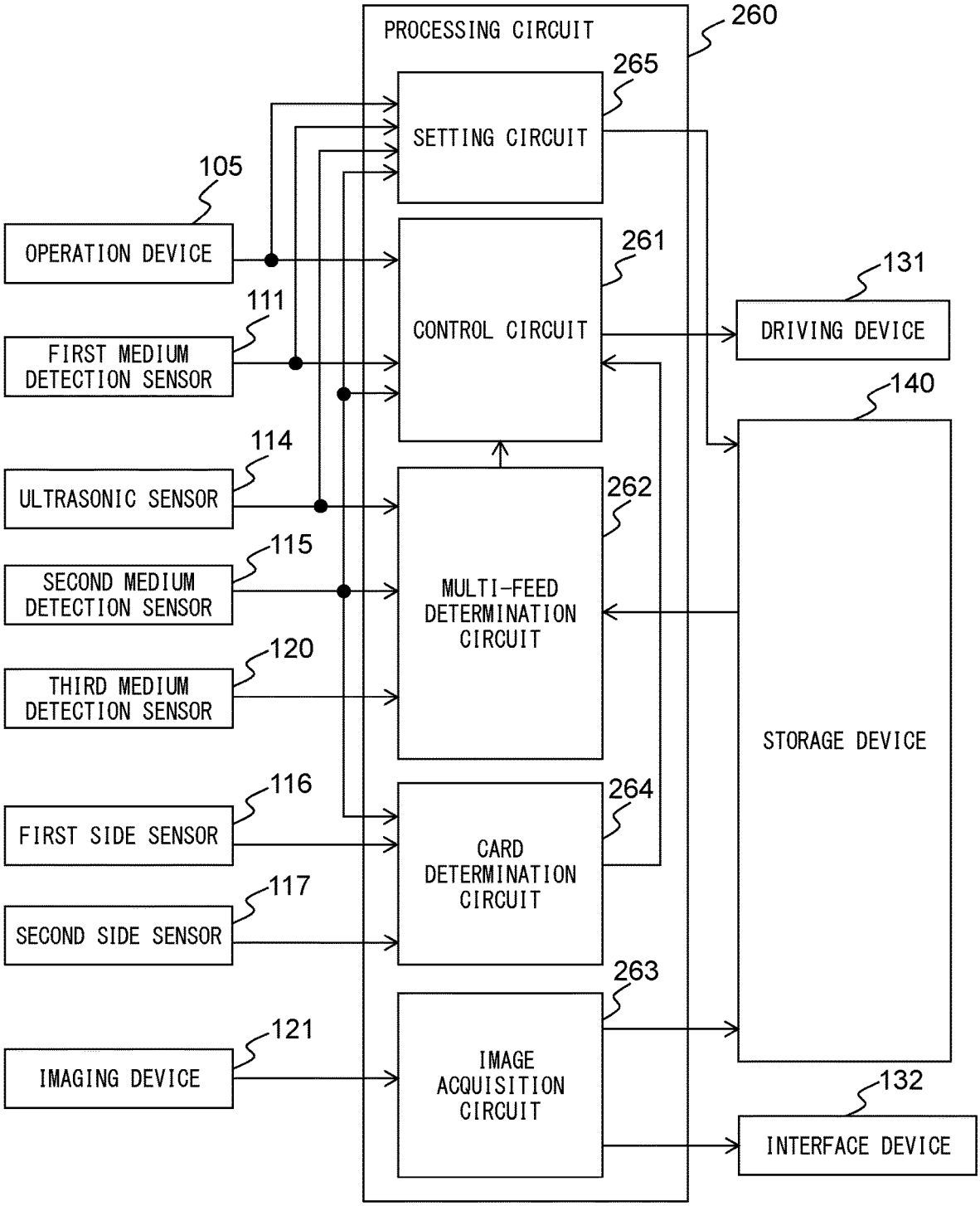
FIG. 10 is a diagram illustrating a schematic configuration of another processing circuit 260.

FIG. 10 is a diagram illustrating a schematic configuration of a processing circuit 260 in the multi-feed detection apparatus according to another embodiment.

The processing circuit 260 is used in place of the processing circuit 160 of the multi-feed detection apparatus 100 and executes the medium reading processing and the setting processing in place of the CPU 150. The processing circuit 260 includes a control circuit 261, a multi-feed determination circuit 262, an image acquisition circuit 263, a card determination circuit 264 and a setting circuit 265, etc. Note that each unit may be configured by an independent integrated circuit, a microprocessor, firmware, etc.

The control circuit 261 is an example of a control module and has a function similar to the control module 151. The control circuit 261 receives the operation signal from the operation device 105, the first detection signal from the first medium sensor 111, the second detection signal from the second medium sensor 115, a determination result of the multi-feed and the medium from the multi-feed determination circuit 262, and a determination result of a card from the card determination circuit 264. The control circuit 261 drives the driving device 131 based on the received information, returns the medium to the medium tray 103, or stops conveying the medium.

The multi-feed determination circuit 262 is an example of the multi-feed determination module and has a function similar to the multi-feed determination module 152. The multi-feed determination circuit 262 receives the second detection signal from the second medium sensor 115, the third detection signal from the third medium sensor 120, and the ultrasonic signal from the ultrasonic sensor 114, and reads the first threshold value and the second threshold from the storage device 140. The multi-feed determination circuit 262 determines whether or not the multi-feed of the medium has occurred and whether or not the medium is a non-thin paper or a thin paper based on the acquired information, and outputs the determination result to the control circuit 261.

The image acquisition circuit 263 is an example of an image acquisition module and has a function similar to the image acquisition module 153. Image acquisition circuit 263 receives the input image from the imaging device 121, stores the input image in the storage device 140, and transmits the input image to the information processing apparatus (not shown) through the interface device 132.

The card determination circuit 264 is an example of a card determination module and has a function similar to the card determination module 154. The card determination circuit 264 receives the second detection signal from the second medium sensor 115, the first side signal from the first side sensor 116 and the second side signal from the second side sensor 117. The card determination circuit 264 determines whether or not the fed medium is a card based on the received signal, and outputs the determination result to the control circuit 261.

The setting circuit 265 is an example of a setting module, and has a function similar to the setting module 155. The setting circuit 265 receives the operation signal from the operation device 105, the first detection signal from the first medium sensor 111, the second detection signal from the second medium sensor 115, and the ultrasonic signal from the ultrasonic sensor 114. The setting circuit 265 sets the first threshold value and the second threshold based on the received signal, and stores them in the storage device 140.

As described in detail above, the multi-feed detection apparatus can suitably determine whether or not the multi-feed detection apparatus returns the fed medium to the direction of the medium tray when the multi-feed occurs, even when the processing circuit 260 is used.

REFERENCE SIGNS LIST

100 Multi-feed Detection Apparatus
103 Medium Tray
112 Feed Roller
113 Brake Roller
114 Ultra Sonic Sensor
118 First Conveyance Roller
119 Second Conveyance Roller
151 Control Module
152 Multi-feed Detection Module
153 Card Determination Module
154 Setting Module

The invention claimed is:

1. A multi-feed detection apparatus, comprising:
a medium tray;
a feed roller to feed a medium placed on the medium tray;
an ultrasonic sensor to generate an ultrasonic signal corresponding to a received ultrasonic wave; and
a processor to
determine that feeding of the medium is normal when a signal value of the ultrasonic signal is equal to or more than a first threshold value, determine that a multi-feed of the medium has occurred when the signal value of the ultrasonic signal is less than the first threshold value, and
control the feed roller to return the fed medium to a direction of the medium tray when the signal value of the ultrasonic signal is less than a second threshold value smaller than the first threshold value, and not to return the fed medium to the direction of the medium tray when the signal value of the ultrasonic signal is less than the first threshold and equal to or more than the second threshold even when it is determined that the multi-feed of the medium has occurred.

2. The multi-feed detection apparatus according to claim 1, wherein the processor determines whether the fed medium is a card when the signal value of the ultrasonic signal is less than the first threshold value and is equal to or more than the second threshold value, and continues to convey the medium when the fed medium is a card.

3. The multi-feed detection apparatus according to claim 2, wherein the processor stops conveying the medium or notifies a user of a warning when the signal value of the ultrasonic signal is less than the first threshold, equal to or more than the second threshold, and the fed medium is not a card.

4. The multi-feed detection apparatus according to claim 1,
further comprising a conveyance roller provided on a downstream side of the feed roller in a medium conveying direction, to convey the medium fed by the feed roller, wherein
the processor does not return the fed medium to the direction of the medium tray after a front end of the fed medium has passed through the conveyance roller.

5. The multi-feed detection apparatus according to claim 1, wherein the processor feeds the medium placed on the medium tray to set the first threshold value or the second threshold based on the ultrasonic signal generated by the ultrasonic sensor when the processor receives a setting instruction by a user.

6. A control method of a multi-feed detection apparatus, the method comprising:

feeding a medium placed on a medium tray by a feed roller;

transmitting an ultrasonic wave by an ultrasonic transmitter;

generating an ultrasonic signal corresponding to a ultrasonic wave received by a an ultrasonic receiver;

determining that feeding of the medium is normal when a signal value of the ultrasonic signal is equal to or more than a first threshold value;

determining that a multi-feed of the medium has occurred when the signal value of the ultrasonic signal is less than the first threshold value; and controlling the feed roller to return the fed medium to a direction of the medium tray when the signal value of the ultrasonic signal is less than a second threshold value smaller than the first threshold value, and not to return the fed medium to the direction of the medium tray when the signal value of the ultrasonic signal is less than the first threshold and equal to or more than the second threshold even when it is determined that the multi-feed of the medium has occurred.

7. The method according to claim 6, further comprising:

determining whether the fed medium is a card when the signal value of the ultrasonic signal is less than the first threshold value and is equal to or more than the second threshold value; and continuing to convey the medium when the fed medium is a card.

8. The method according to claim 7, further comprising stopping conveying the medium or notifying a user of a warning when the signal value of the ultrasonic signal is less than the first threshold, equal to or more than the second threshold, and the fed medium is not a card.

9. The method according to claim 6, further comprising conveying the medium fed by a feed roller by a conveyance roller provided on a downstream side of the feed roller in a medium conveying direction, wherein the fed medium is not returned to the direction of the medium tray after a front end of the fed medium has passed through the conveyance roller.

10. The method according to claim 6, further comprising feeding the medium placed on the medium tray to set the first threshold value or the second threshold based on the ultrasonic signal generated by the ultrasonic receiver when a setting instruction by a user is received.

11. A computer-readable, non-transitory medium storing a computer program, wherein the computer program causes a multi-feed detection apparatus including a medium tray, a feed roller to feed a medium placed on the medium tray, an ultrasonic sensor including an ultrasonic transmitter to transmit an ultrasonic wave and an ultrasonic receiver to generate an ultrasonic signal corresponding to a received ultrasonic wave, to execute a process, the process comprising:

determining that feeding of the medium is normal when a signal value of the ultrasonic signal is equal to or more than a first threshold value;

determining that a multi-feed of the medium has occurred when the signal value of the ultrasonic signal is less than the first threshold value; and controlling the feed roller to return the fed medium to a direction of the medium tray when the signal value of the ultrasonic signal is less than a second threshold value smaller than the first threshold value, and not to return the fed medium to the direction of the medium tray when the signal value of the ultrasonic signal is less than the first threshold and equal to or more than the second threshold even when it is determined that the multi-feed of the medium has occurred.

12. The computer-readable, non-transitory medium according to claim 11, the process further comprising:

determining whether the fed medium is a card when the signal value of the ultrasonic signal is less than the first threshold value and is equal to or more than the second threshold value; and continuing to convey the medium when the fed medium is a card.

13. The computer-readable, non-transitory medium according to claim 12, further comprising stopping conveying the medium or notifying a user of a warning when the signal value of the ultrasonic signal is less than the first threshold, equal to or more than the second threshold, and the fed medium is not a card.

14. The computer-readable, non-transitory medium according to claim 11, wherein the multi-feed detection apparatus includes a conveyance roller provided on a downstream side of the feed roller in a medium conveying direction, to convey the medium fed by the feed roller, and wherein the fed medium is not returned to the direction of the medium tray after a front end of the fed medium has passed through the conveyance roller.

15. The computer-readable, non-transitory medium according to claim 11, the process further comprising feeding the medium placed on the medium tray to set the first threshold value or the second threshold based on the ultrasonic signal generated by the ultrasonic receiver when a setting instruction by a user is received.

* * * * *